United States Patent [19]

Landry

[11] Patent Number: 4,865,016

[45] Date of Patent: Sep. 12, 1989

[54] AUTOMATIC LOG FEEDER FOR FIREPLACES

[76] Inventor: Joseph L. Landry, Rte. 1, Box 725, Sunset, La. 70584

[21] Appl. No.: 249,685

[22] Filed: Sep. 27, 1988

[51] Int. Cl.[4] ..... F24B 13/04

[52] U.S. Cl. ..... 126/501; 126/68; 126/73; 110/101 C; 110/108; 110/293; 414/176; 414/196; 414/198

[58] Field of Search ..... 126/501, 68, 73; 110/101 C, 108, 110, 109, 116, 118, 286, 293; 414/176, 196, 198

[56] References Cited

U.S. PATENT DOCUMENTS

| | | | |
|---|---|---|---|
| 3,888,231 | 6/1975 | Galluzzo et al. | 126/73 |
| 4,307,700 | 12/1981 | Michael | 126/68 |
| 4,421,040 | 12/1983 | Lindstrom | 126/73 |
| 4,442,825 | 4/1984 | Waldan | 126/68 |
| 4,444,538 | 4/1984 | Manley | 110/293 |
| 4,530,289 | 7/1985 | Godbout | 126/68 |
| 4,539,915 | 9/1985 | Bouron | 1109/101 C |

FOREIGN PATENT DOCUMENTS

| | | | |
|---|---|---|---|
| 2444892 | 8/1980 | France | 126/73 |

*Primary Examiner*—James C. Yeung
*Attorney, Agent, or Firm*—Joseph L. Lemoine, Jr.

[57] ABSTRACT

An automatic log feeder for fireplaces is provided which includes an upper horizontal conveyor, an intermediate carriage mechanism and a lower horizontal conveyor. The upper horizontal conveyor is used to store a plurality of logs outside of a building and to advance individual logs through the feeder as desired. Through use of a unique guide rail and rail following bracket the intermediate carriage mechanism receives individual logs from the upper conveyor and lowers them to the lower conveyor while simultaneously changing orientation of the individual logs by 90° before depositing them onto the lower conveyor. The lower conveyor is adapted to automatically advance individual logs into the fireplace in a cantilevered fashion before gently tipping them onto the fireplace grating, or, allows for manual removal of the log from the lower conveyor through an access door extending to the interior of a building.

7 Claims, 3 Drawing Sheets

FIG. 1
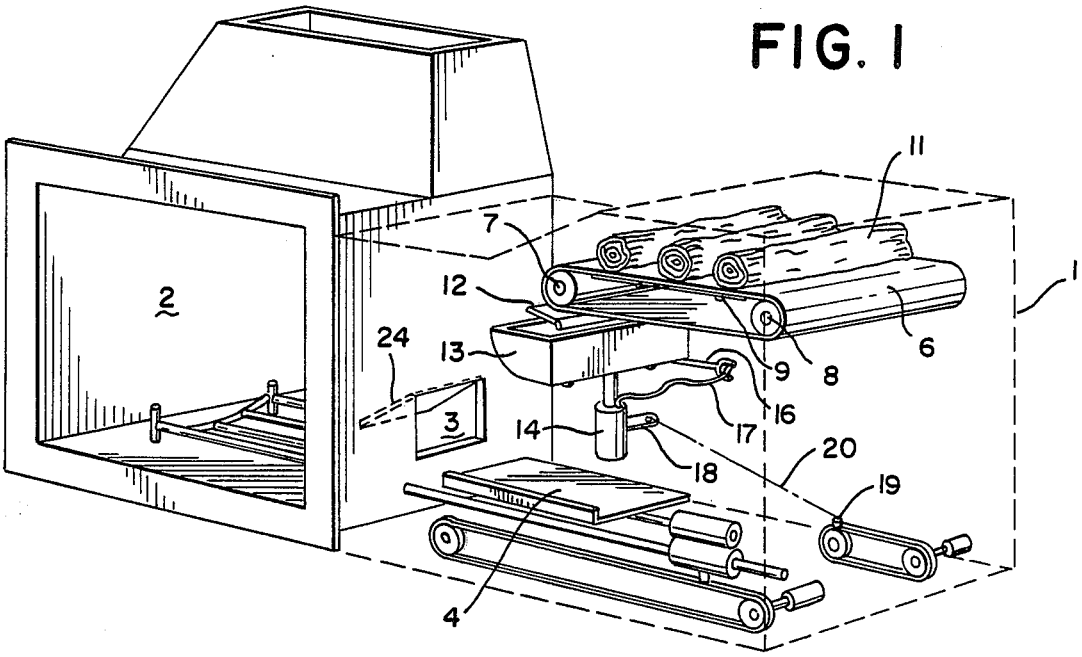
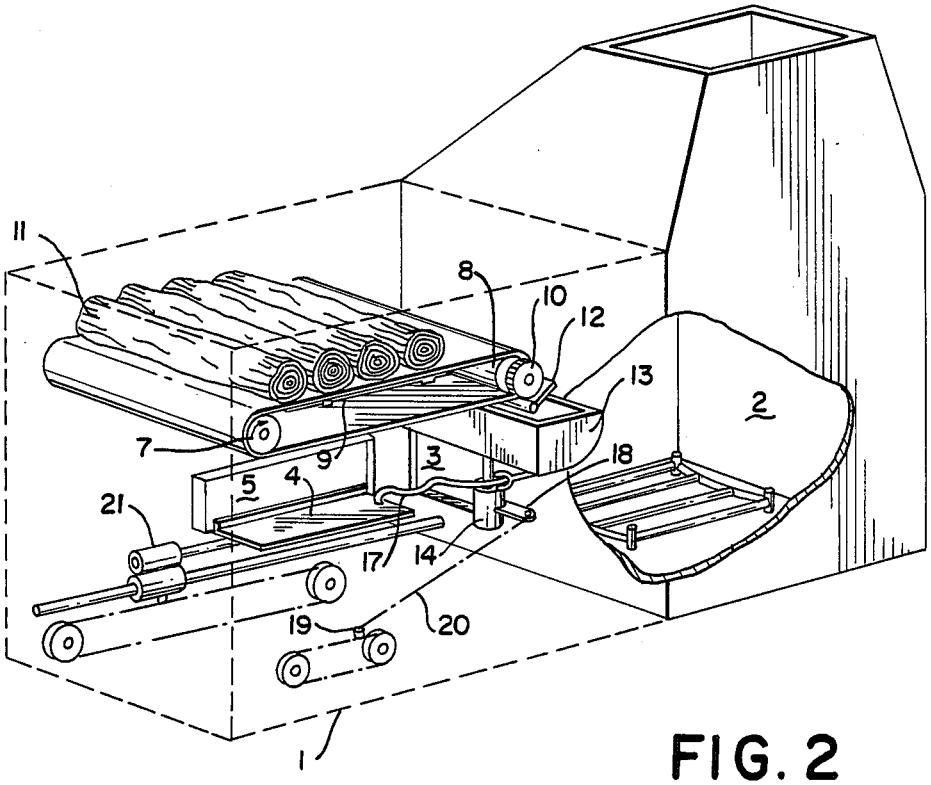
FIG. 2

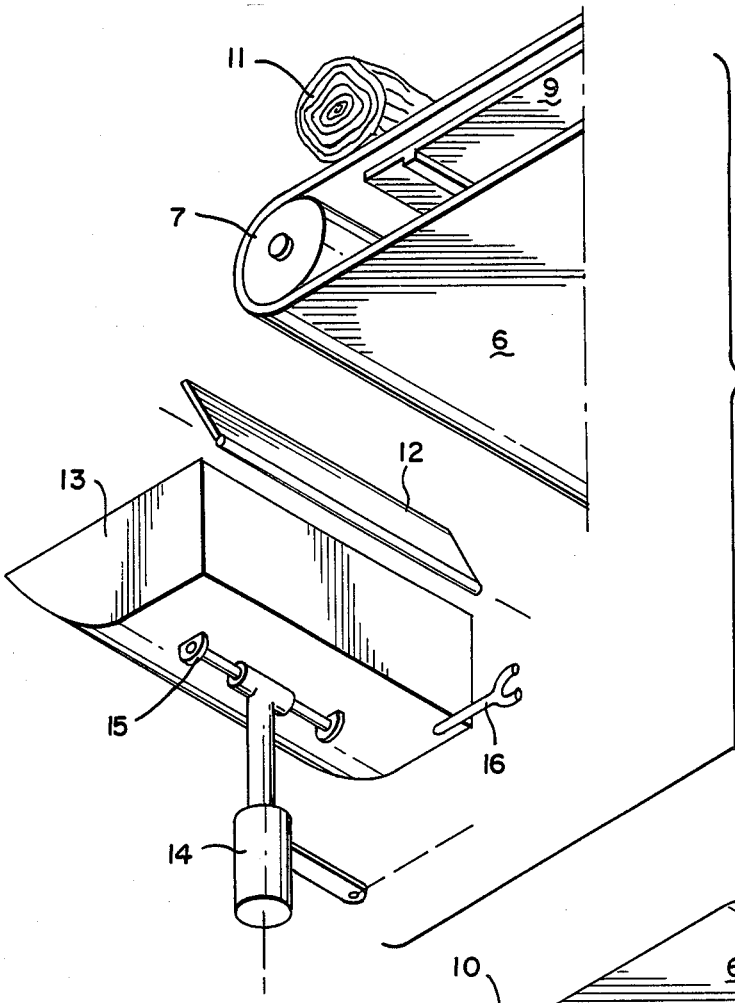
FIG. 3
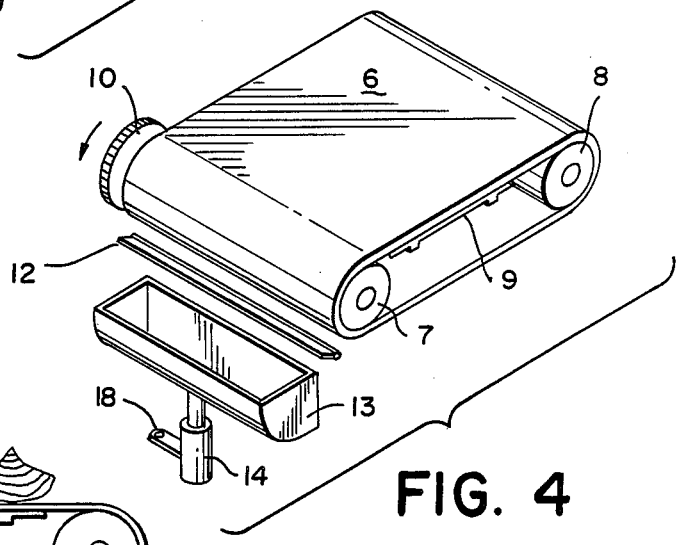
FIG. 4
FIG. 5
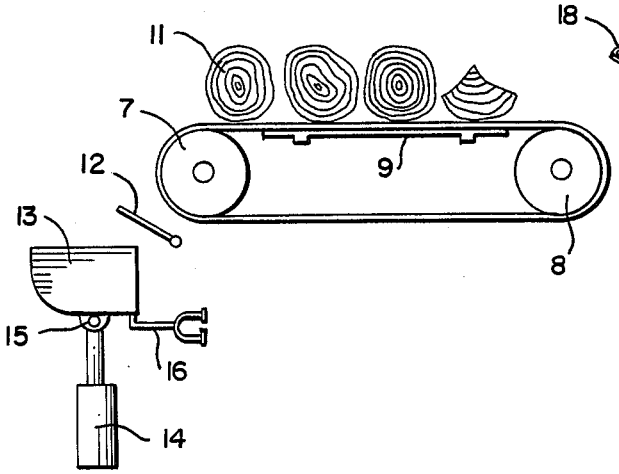

AUTOMATIC LOG FEEDER FOR FIREPLACES

BACKGROUND OF THE INVENTION

1. Field of the Invention

This invention relates to apparatus used to automatically supply logs for use in a woodburning fireplace. The invention is operated in either of two modes: (a) to automatically place a log into the fireplace grating, or, (b) to allow a log to be removed from the apparatus, by hand, from the interior of a building, for placement into the fireplace by hand.

2. Discussion of Prior Art

A variety of devices are known for supplying logs to fireplaces.

FISHER, U.S. Pat. No. 591,752, discloses an apparatus for feeding solid fuel to a furnace which incorporates an operating rod and a hinged door adjacent to a furnace opening.

JOSTEN, U.S. Pat. No. 742,198, discloses a furnace with an automatic solid fuel feeding device. The back of the stove includes a pivotal fire door or valve, which pivots into the stove when solid fuel is delivered to the device from a solid fuel containing slidable receptacle or magazine. The magazine is comprised of a series of superimposed inclined pockets or compartments. A grate is provided for retaining the solid fuel delivered by the feeding device.

GARDNER, U.S. Pat. No. 789,849, discloses a coal feeder for a furnace which includes an endless conveyor belt in the form of an elevator having a plurality of buckets attached to it for carrying coal from a supply feed hopper to a charge hopper.

ZAMERNICK, U.S. Pat. No. 1,335,265, discloses an automatic fuel feeder for wood burning stoves which has a fuel magazine comprising an upwardly and rearwardly inclined wall and a plurality of pawls which are adapted to support logs or other solid wood blocks. A roller is provided with arms and a handle is moved rearwardly to rotate a shaft and withdraw the pawls from beneath the lowermost block so that it will descend along the teeth of a roller. The roller rotates under the influence of the weight of the block, and the block is thus deposited upon the rear edge of the cover of the furnace so that each block will fall into the stove and rest upon a grate bar.

MONZEIN, French Pat. No. 2,444,892, discloses a fireplace log feeder which is moved by a plurality of wheels. The feeder includes a timer which activates a motor to drive a conveyer and periodically, at timed intervals, deposit logs in a fireplace chamber.

NORMAN, U.S. Pat. No. 2,454,400, discloses an automatic log stroker for furnaces which comprises a hopper and a spring loaded pusher for feeding logs into an arcuate fire box. The arcuate fire box conducts the logs to a rotary grate.

GALLUZO et al., U.S. Pat. No. 3,888,231, discloses a fireplace structure having a telescoping feed assembly and a fuel hopper assembly comprising a storage container filled with fuel to be dispensed through a loading door; the fuel used is preferably coal. The container opens at its lower end through an opening, which in turn communicates the container with a removable chute. The chute is shaped substantially in the form of a rectangular box and extends into a fire chamber via a rack, where it is fitted with a fire proof tap along its inner end.

FIKE, U.S. Pat. No. 4,126,119, discloses a fireplace having an arrangement for feeding long logs, at least two at a time, to a combustion chamber. A long tunnel or enclosure having a plurality of walls includes a mouth which is framed by a side wall opening of the firebox. An exterior door opens to the log enclosure and a feed assembly which is provided with log drive rollers which assist in feeding logs to the chamber. Additionally, a coal supply enclosure can be provided which includes a hopper having an inclined bottom wall for delivering coal to the upper surface of a chain belt. The chain belt comprises an endless conveyor driven by a motor.

GROSSNIKLAUS, U.S. Pat. No. 4,185,567, discloses a wood fired furnace assembly which has a device for feeding wood to the furnace. The device comprises a ram aligned with a feed duct, which in turn leads to a fire chamber. A flap is provided to push any wood lying against a wall towards an aperture so that the ram plunger will contact and break up the wood in front of the aperture, thus pushing the wood into the feed duct. The feed duct, in turn, conducts wood in the direction of the fire chamber.

MICHEAL, U.S. Pat. No. 4,307,700 discloses a device for automatically charging a wood burning stove with logs. The device includes a rod-like member and arcuately-shaped log supporting members. A time relay is provided for releasing latching means to allow the log, supporting members to pivot downwardly, and to drop desired logs onto the fireplace.

FINCH, U.S. Pat. No.4,339,998, discloses a fuel level indicator which may be used to actuate a rearward mounted, partitioned conveyor, which advances incrementally thereby depositing a load of fuel in an inclined chute, which, in turn, allows logs to slide into the fireplace.

MANLEY, U.S. Pat. No. 4,444,538, discloses an automatic log feeder for fireplaces which comprises a vertically arranged, partitioned storage hopper and chute which dispenses individual logs onto foldable brackets mounted on a vertical chain conveyor. In turn the chain conveyor deposits the individual logs onto a horizontal conveyor which pushes the log through a hinged door and into the fireplace.

BOURON, U.S. Pat. No. 4,539,915, discloses an automatic fuel feeder for wood burning boilers which comprises a grated combustion chamber, storage means, a split, semi-cylindrical shaped carriage for receiving successive charges of fuel from storage means and thereafter discharging the charge into the combustion chamber, and conveyor means for moving the carriage means between the combustion chamber and storage means. A partitioned storage magazine, mounted perpendicular to the carriage mechanism, rotates to discharge a load fuel onto the carriage bin. Thereafter the loaded carriage bin is moved into a position cantilevered into the combustion chamber whereupon the carriage bin opens to discharge the fuel. After discharge of the fuel the carriage bin closes, withdraws from the combustion chamber and returns to the storage magazine.

None of these patents disclose the particular delivery apparatus disclosed in the present invention, that is, none discloses delivery by means of two parallel, non-partitioned, and horizontally arranged conveyor mechanisms, one mounted over the other (a means of saving space and making the feeder more compact and efficient). What makes this space saving "stacked" conveyor mechanism possible is the unique intermediate carriage mechanism, disclosed herein, which not only transports the log from the upper conveyor to the lower conveyor, but also translates the orientation of the log, from a storage position at right angles to the direction of travel of the upper conveyor (necessary for efficient use of storage space) to an orientation which is aligned with the direction of travel of the lower conveyor (necessary for insertion of the log through a small hinged door on the side of the fireplace). Further, none of these patents disclose the cantilevered lower conveyor tray, shown herein, for gently tipping the log onto the fireplace hearth.

OBJECTS OF THE INVENTION

The general objects of the present invention is to provide a new and improved means whereby fireplace logs stored outside of a building are automatically made accessible to the interior of the building, when desired, thereby eliminating insect problems associated with indoor firewood storage reducing personal inconvenience, cleanliness in the home problems, and heating losses associated with frequent outdoor excursions during inclement weather.

Another object of the invention is to provide a means for weatherproof outdoor storage of logs which is capable of being easily loaded with a plurality of logs.

A further object of this invention is to provide a log feeder that is esthetically unobtrusive, being generally compact such that it can be mounted outdoors, in the "corner" usually formed between the exterior side wall of a fireplace and an exterior wall of the building, and thereby not appreciably detract from the exterior appearance of a residential structure.

Yet a further object of the invention is to provide a log feeder which provides for gentle placement of logs into the fireplace, or, alternatively allows manual access to the logs from the interior of the building when the user desires to manually place the logs into the fireplace.

Yet another object of the invention is to eliminate the need for partitioned or compartmentalized storage and/or conveyor devices, which are generally expensive to manufacture, relatively non-durable, and are generally susceptible to jamming or malfunction, particularly if longitudinally split log sections of non-uniform diameter and length are used.

SUMMARY OF THE INVENTION

The improved automatic log feeder for fireplaces, according to the present invention, is characterized by two horizontal conveyor means, one mounted above the other. The upper conveyor belt stores a plurality of, either cylindrically shaped or longitudinally split, logs, of non-critical length, which are placed approximately at a right angle to the direction of conveyor belt travel. Upon actuation of the log feeder cycles as follows: The upper conveyor advances until one log goes through a metering gate and is deposited in an intermediate carriage tray. Upon deposition of the log in the intermediate carriage tray, the intermediate carriage tray, by motorized means, rotates the orientation of the log by 90° around a vertical axis and then deposits the log onto the lower conveyor. This 90° translation of the intermediate carriage tray, and therefore the log therein, is consistently achieved, with precision, by means of rail following device attached to the intermediate carriage tray, which is slidably attached to a somewhat helically shaped rail. As the intermediate carriage tray approaches the lower conveyor, the end of the somewhat helically shaped rail has a semi-circular reverse bend which tips the intermediate carriage tray over, depositing a log onto the lower conveyor tray. Upon deposition of a log onto the lower conveyor tray, the log feeder is pre-loaded and the intermediate carriage returns to the upper conveyor and operation of the log feeder is suspended until further actuation.

At this point the user of the log feeder has two options, which are: (a) to manually open a hinged access door on the interior wall of the building and manually remove the log from the lower conveyor tray (at which point, upon closing the access door, the log feeder will automatically recycle, one time, and preposition the next stored log on the lower conveyor tray), or, (b) typically by remote control, to actuate the lower conveyor so that it inserts the prepositioned log directly into the fireplace through an opening in the side of the fireplace. If the lower conveyor is actuated by remote control, a tray slidably attached to a guide rail advances into the fireplace through a hinged door. Near the end of lower conveyor travel, a downward bend of its guide rail tips the lower conveyor tray over and allows a log to fall into the fireplace. After deposition of a log into the fireplace the lower conveyor retracts to its original position and the log feeder will automaticcaly recycle, one time, thereby prepositioning the next stored log onto the lower conveyor (where it can then be extracted either manually, as aforesaid, or automatically be fed into the fireplace, also as aforesaid; when desired).

BRIEF DESCRIPTION OF THE DRAWINGS

Further details are explained below with the help of the examples illustrated in the atached drawings in which:

FIG. 1 is a perspective view of the preferred embodiment of the automatic log feeding apparatus of the present invention.

FIG. 2 is another perspective view of the preferred embodiment of the automatic log feeding apparatus of the present invention.

FIG. 3 is a perspective view of a portion of the upper conveyor mechanism, metering gate and intermediate carriage mechanism of the preferred embodiment.

FIG. 4 is another perspective view of the upper conveyor mechanism, metering gate and intermediate carriage mechanism of the preferred embodiment.

FIG. 5 is a sectional view of the upper conveyor mechanism, metering gate and intermediate carriage mechanism.

DESCRIPTION OF THE PREFERRED EMBODIMENT

Figure 6:
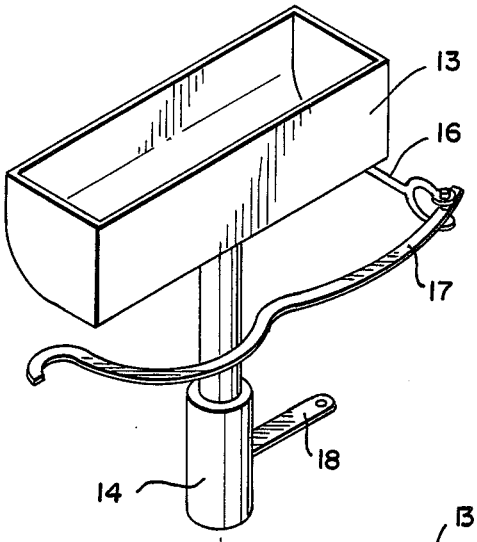
FIG. 6 is a perspective view of the intermediate carriage mechanism and its control rail.

With reference to FIGS. 1 and 2, an automatic log feeder for fireplaces, which is held within casing 1 (shown in dotted lines). As illustrated the log feeder is shown supplying a fireplace 2 with logs to be burned. As illustrated the logs may be automatically fed directly into the fireplace through hinged door 3 or they may be manually extracted from the lower conveyor tray 4 through hinged door 5 from the interior of the building.

With specific reference to FIGS. 3, 4 and 5, first major component of the log feeder is the upper horizontal conveyor. In the preferred embodiment an endless flexible belt 6 is mounted between two cylindrical rollers 7 and 8. The top section of the upper conveyor belt slidably rests on support sheet 9 in order to enhance the weight bearing characteristics of the belt.

In the preferred embodiment the upper conveyor belt is driven by means of a pulley 10 attached to the forward cylindrical roller 7, as aforesaid. Said pulley can be driven by any number of conventional motorized drive means.

A single row of logs 11, of any cross-sectional shape or length (provided the length of the logs is less than width of the belt), is placed on top of the upper conveyor belt 6 at right angles to the direction of belt travel. Spacing between the various logs is not critical, because the upper conveyor belt 6, once actuated, continues to advance forward until a metering gate 12 senses that a log has fallen off the belt 6 onto the intermediate carriage tray 13.

In the preferred embodiment the metering gate 12 consists of a hinged metal plate 12 which rotates downward and thereby momentarily actuates a switch (not shown) when a log, falling by force of gravity, strikes the hinged plate 12. However, as can be readily seen, the metering gate may consist of other conventional detection devices, including photo-electric monitors, hydraulic or mechanically actuated detectors. Upon momentary actuation of the metering gate 12 the upper conveyor belt 6 is de-energized until the remainder of the log feeder cycle is completed.

With specific reference to FIGS. 3, 4, 5, 6 and 7, the next major component of the log feeder is the intermediate carriage mechanism.

In the preferred embodiment the intermediate carriage mechanism consists of an intermediate carriage tray 13, support shaft 14, pivot rod and brackets 15, rail following bracket 16, a somewhat helical guide rail 17 and actuating arm 18 for rotating said support shaft.

When the metering gate 12 detects that a log has dropped into the intermediate carriage tray 13, the intermediate carriage mechanism is automatically actuated. In the preferred embodiment a slidably mounted bushing 19 operates a control rod 20 which in turn pulls the actuating arm 18 rearward. Rearward movement of the actuating arm causes the support shaft 14 to rotate in a clockwise direction (as viewed from above). As can be readily seen a variety of other means, mechanical, pneumatic, hydraulic or electrical could be used to rotate the support shaft. As the support shaft is attached to the intermediate carriage tray 13 through a pivot rod and bracket 15, clockwise rotation of the support shaft 14 causes the intermediate carriage tray 13 to rotate, about a vertical axis, in a clockwise direction as viewed from above.

Further motion of the intermediate carriage tray 13, about a horizontal axis, is accomplished by means of a rail following bracket 16 which is slidably engaged with an intermediate guide rail 17. The guide rail 17 is somewhat helically shaped, and therefore as the intermediate carriage tray rotates clockwise, action of the rail follower bracket 16 causes the intermediate carriage tray to move downward and about a horizontal axis (more specifically, around the pivot rod and bracket 15). Therefore as the intermediate carriage tray 13 rotates 90° about a vertical axis (thereby changing orientation of the log from one at right angles to conveyor travel to an orientation parallel to conveyor travel) the intermediate carriage tray also rotates about a horizontal axis (thereby gently tipping a log onto the lower conveyor tray 4 at the appropriate point. After depositing a log onto the lower conveyor tray 4 the intermediate carriage mechanism, through action of a limit switch (not shown) or other such means, reverses its direction of travel and returns to the upper conveyor belt 6. Upon said return of the intermediate carriage mechanism all further movement of the log feeder stops until further actuation.

Figure 7:
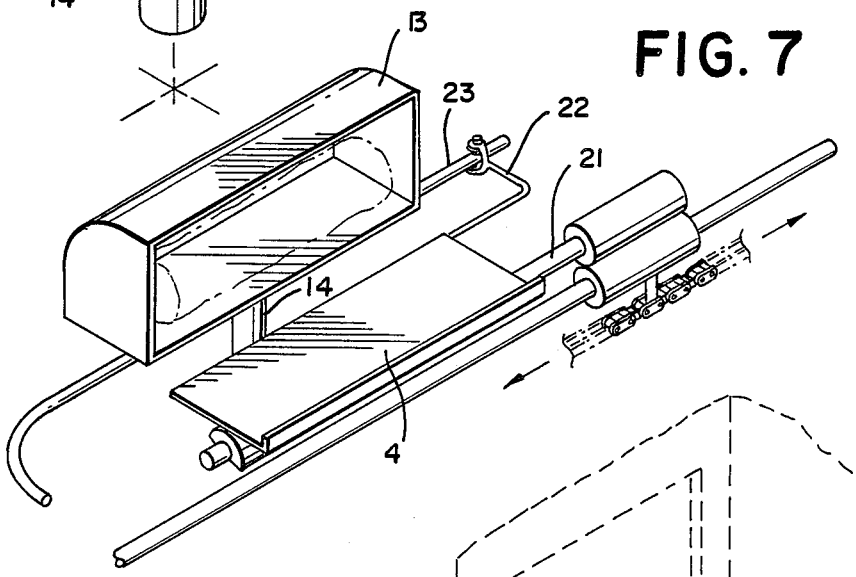
FIG. 7 is a perspective view of the intermediate carriage tray (in its lower position) depositing a log onto the lower conveyor mechanism.
Figure 8:
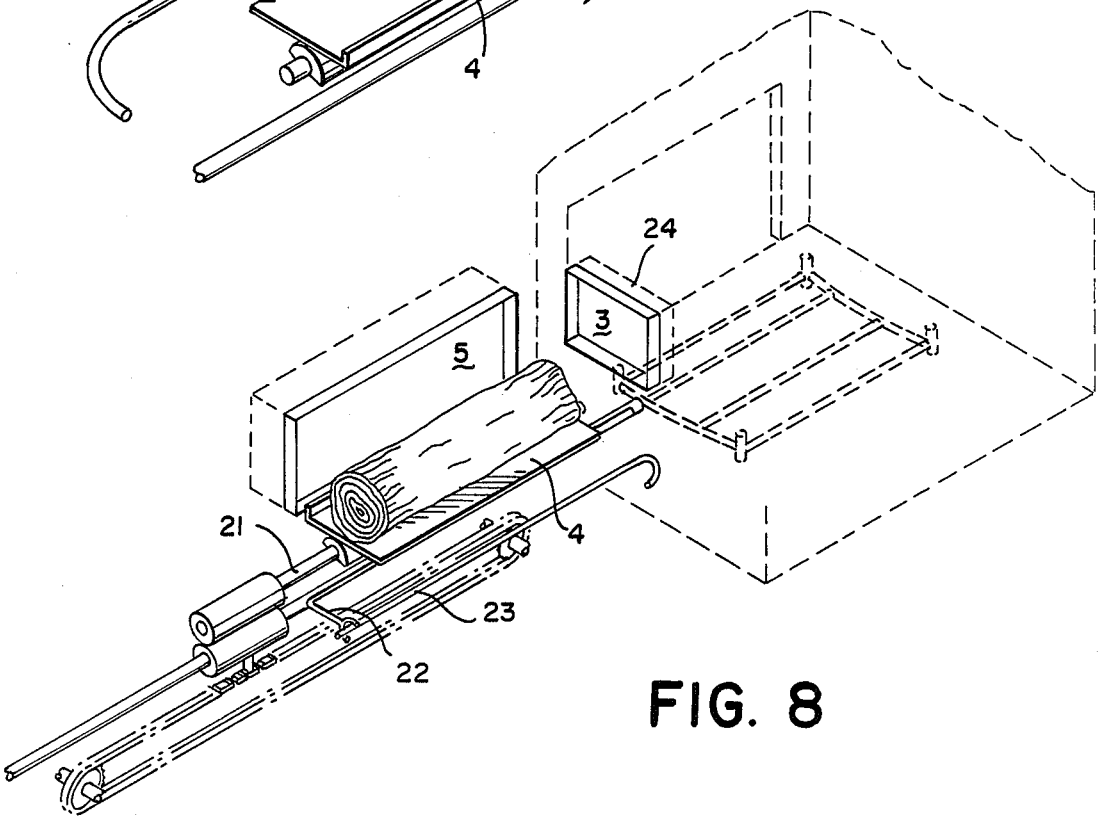
FIG. 8 is a perspective view of the lower conveyor mechanism and its guide rail.

With specific reference to FIGS. 7 and 8, the third major component of the log feeder is the lower conveyor mechanism. The lower conveyor mechanism is comprised of a lower conveyor tray 4 which is rotatably engaged to the support shaft 21, a rail following bracket 22, a guide rail curved downward near its end 23, a hinged fireplace door 3, a hinged door to the interior of the building 5 and motorized means for advancing the support shaft forward and backward.

After the intermediate carriage mechanism deposits a log in the lower conveyor tray 4 and the intermediate carriage tray 13 returns to the upper conveyor belt 6, a log remains in the lower conveyor tray until further actuation of the log feeder occurs. Further actuation of the log feeder may be accomplished by either of two means. First, should the user desire to manually place the log in the fireplace, that may be accomplished by manual removal of the log through hinged interior door 5. Upon manual removal of the log and reclosure of hinged interior door 5 the log feeder will automatically recycle, as aforesaid (that is, the upper conveyor mechanism will advance until one log is deposited into the intermediate carriage tray, the intermediate carriage will transport the log to the lower conveyor and return to its upper position, and, all further operation of the log feeder will stop until further actuation occurs). Alternatively (rather than manual removal of the log from the log feeder), should the user desire automatic placement of the log onto the fireplace, that may be accomplished by actuating the lower conveyor advancing mechanism, typically by remote control. Upon actuation of the lower conveyor the support shaft 21 is advanced forward through hinged fireplace door 3. Advancement in the preferred embodiment is accomplished by a sprocket and chain drive which is driven by electric motor. As can be readily seen other advancement mechanisms, such as jack-screw drives, pneumatic hydraulic or electrical could also be used. As the lower conveyor support shaft (and lower conveyor tray) 4 advances through hinged fireplace door 3 the lower control conveyor tray 4 remains level by action of a guide rail and slidably engaged rail following bracket 22 (attached to the lower conveyor tray). As the lower conveyor tray 4 advances further into the fireplace, a downward bend of the guide rail 23 acting on the rail following bracket 22 causes the lower conveyor tray 4 to rotate about the lower conveyor support shaft 21 in a clockwise direction (as viewed from the rear of the log feeder) thereby tipping the log into the combustion chamber of the fireplace. After lower conveyor support shaft 21 has reached full extension, typically by means of a limit switch, the support shaft 21 reverses direction, withdraws back into the log feeder. When withdrawal is complete, the log feeder will automatically recycle, as aforesaid (that is, the upper conveyor will advance and the intermediate carriage mechanism will preposition another log in the lower conveyor tray).

The log feeder is simple and easy to use. Once the apparatus is loaded with wood and energized, the device will automatically preposition one log of wood in the lower conveyor tray where it can either be manually removed from the interior of a building, or alternatively, the lower conveyor can be actuated to automatically deposit the log into the fireplace. Upon removal of the prepositioned log, by manual or automatic means as aforesaid, the log feeder will automatically preposition the next log to await the user's convenience. Alternatively, a timer can be adapted to continuously supply logs to a fireplace at periodic intervals. By lengthening the upper conveyor or by feeding it from a suitable hopper, the log feeder can be adapted to store and supply a larger plurality of logs than is shown in the preferred embodiment.

By use of the log feeder a fireplace may be automatically supplied with logs to be burned in a convenient, clean, safe and efficient manner. Other than loading a plurality of logs onto the upper conveyor (or storage hoop, if utilized) from time to time, and actuating the unit (either by manually, by remote control or by automatic timer, if desired), the apparatus requires little manual labor or supervision.

While the preferred embodiment of the invention has been described and shown, it is understood that many modifications may be made without departing from the spirit and scope of the invention.

What is claimed is:

1. An automatic log feeder, in combination with a fireplace, comprising:

(a) a first, generally horizontal upper conveyor means for storing a plurality of logs at right angles to the direction of upper conveyor travel, and for advancing an individual log through the feeder on command, said first conveyor comprising: motor-driven means, an endless flexible belt of sufficient width to accommodate logs of desired length, a plurality of cylindrical rollers upon which the belt is mounted and a belt support means adequate to prevent significant deflection of said belt when fully loaded with logs; and (b) a metering means for detecting the advancement of an individual log from the upper conveyor means; and (c) an intermediate carriage means, mounted generally below said upper conveyor means, for receiving individual logs from said upper conveyor means, for translating orientation of the logs by 90° and for depositing said individual log onto a lower conveyor below, said intermediate carriage means comprising a rotatable and substantially vertical support shaft, motorized means for rotating said support shaft about a vertical axis, an arcuate shaped tray which is connected to said substantially vertical support shaft by means of a horizontal pivot rod and brackets, said arcuate tray also being slidably connected to a somewhat curved control rail which causes the tray to tip over near as the support shaft is rotated; and (d) a second, generally horizontal lower conveyor means, mounted generally below said intermediate carriage means, for receiving individual logs from said intermediate carriage means, and for advancement of the individual log into the fireplace through a hinged fireplace door said lower conveyor comprising a slidably engaged substantially horizontal support shaft, motorized means for advancing said substantially horizontal support shaft in a generally horizontal direction, an arcuate tray rotably engaged to said horizontal support shaft, said arcuate tray being further slidably engaged to a curved control rail which causes the tray to tip over as the support shaft is advanced.

2. An automatic log feeder for fireplaces according to claim 1 wherein operation of the apparatus is controlled by a remote control device.

3. An automatic log feeder for fireplaces according to claim 1 wherein operation of the apparatus is controlled by an automatic timing device.

4. An automatic log feeder for fireplaces according to claim 1 wherein the support means for the upper conveyor belt is a substantially horizontal plate mounted below the upper portion of said belt and slidably engaged therewith.

5. An automatic log feeder for fireplaces according to claim 1 wherein the support means for the upper conveyor belt is a plurality of substantially horizontal rollers mounted below the upper portion of said belt and rotably engaged therewith.

6. An automatic log feeder for fireplaces, according to claim 1, further comprising:

(e) access means for removing a log from the lower conveyor, by hand, from the interior of the building the fireplace services, for placement of the log into the fireplace by hand when desired, said access means comprising a hinged door, communicating between the interior of the building and the arcuate tray of the lower conveyor means.

7. An automatic log feeder for fireplaces according to claim 1 wherein logs are fed onto the upper conveyor means from a hopper and chute arrangement which is capable of storing and dispensing a larger plurality of logs than can be stored on the upper conveyor means alone.

* * * * *